US008968843B1

(12) United States Patent
Madrid et al.

(10) Patent No.: US 8,968,843 B1
(45) Date of Patent: Mar. 3, 2015

(54) DECORATION HOLDER

(71) Applicant: Polygroup Macau Limited (BVI), Tortola (VG)

(72) Inventors: Jessica Madrid, East Dundee, IL (US); Eric Steinmeyer, Shenzhen (CN)

(73) Assignee: Polygroup Macau Limited (BVI), Tortola (VG)

( * ) Notice: Subject to any disclaimer, the term of this patent is extended or adjusted under 35 U.S.C. 154(b) by 0 days.

(21) Appl. No.: 14/164,023

(22) Filed: Jan. 24, 2014

Related U.S. Application Data

(60) Provisional application No. 61/874,192, filed on Sep. 5, 2013.

(51) Int. Cl.

| | |
|---|---|
| ***A47G 33/10*** | (2006.01) |
| ***A47G 33/06*** | (2006.01) |
| ***A47G 33/04*** | (2006.01) |
| ***A47G 33/08*** | (2006.01) |

(52) U.S. Cl.
CPC ..... *A47G 33/08* (2013.01); *A47G 33/10* (2013.01)
USPC ..... 428/19; 428/18; 428/20; 428/7

(58) Field of Classification Search
CPC ..... A47G 33/04; A47G 33/06; A47G 33/10; A47G 33/105
USPC ..... 428/7, 18, 19, 20, 21, 22; D6/300, 317, D6/566; D11/117, 118, 121, 141
See application file for complete search history.

(56) References Cited

U.S. PATENT DOCUMENTS

| | | | | |
|---|---|---|---|---|
| 1,972,505 | A * | 9/1934 | Wilson | 248/218.2 |
| 2,083,973 | A * | 6/1937 | Zimmerman | 248/459 |
| 2,192,514 | A * | 3/1940 | Carleton | 40/662 |
| 2,205,496 | A | 6/1940 | Schneider | |
| 2,976,632 | A | 3/1961 | Phillips | |
| 5,071,098 | A | 12/1991 | Aldridge | |
| 2005/0247837 | A1 | 11/2005 | Spencer | |
| 2008/0050541 | A1 | 2/2008 | Trowbridge | |

OTHER PUBLICATIONS

Definition for "string", 2012, http://www.merriam-webster.com/dictionary/string. Accessed at http://web.archive.org/web/20120128145710/http://www.merriam-webster.com/dictionary/string on Jul. 2, 2014.*

(Continued)

*Primary Examiner* — Mark Ruthkosky
*Assistant Examiner* — Julia L Rummel
(74) *Attorney, Agent, or Firm* — Troutman Sanders LLP; Ryan A. Schneider; Benjamin C. Wiles

(57) ABSTRACT

A decoration holder is disclosed herein. In some embodiments, the decoration holder can hold a card, such as a Christmas card, on a tree, such as a Christmas tree. The holder can therefore provide way to decorate a Christmas tree with Christmas cards, thereby enhancing the festive appearance of the tree. The holder can also provide a way to decorate other portions of a user's home with various festive objects.

14 Claims, 6 Drawing Sheets

(56) References Cited

OTHER PUBLICATIONS

Super Market Merchandising, "Oak Banana Tree Display 72" H", for sale in 2011 and published in Super Market Merchandising's 2011 catalog. Accessed at http://www.sm9.com/catalog/product_info.php?cPath=1_147&products_id=1237 on Jul. 7, 2014.*

International Search Report for related GB Application No. GB1403016.7; mailed Aug. 13, 2014.

* cited by examiner

DECORATION HOLDER

CROSS-REFERENCE TO RELATED APPLICATION AND PRIORITY CLAIM

This application claims the benefit, under 35 U.S.C. §119(e), of U.S. Provisional Patent Application No. 61/874,192, filed 5 Sep. 2013, entitled "DECORATION HOLDER," the entire contents and substance of which is incorporated herein by reference in its entirety as if fully set forth below.

BACKGROUND

1. Field of the Invention

The present invention relates to decorative systems, and more specifically, to decoration holders and trees having decoration holders.

2. Description of Related Art

As part of the celebration of the Christmas season, traditionally, people bring a pine or evergreen tree into their home to decorate it with ornaments, lights, garland, tinsel, and the like. Alternatively, in many cases, people use an artificial tree instead of a living tree, and decorate it the same way. When decorating a tree, whether live or artificial, a variety of ornaments are commonly used. These ornaments range from decorative balls to Santa Claus figures to nativity scene recreations. The ornaments, lights, and other decorations can give the tree a desired appearance.

Moreover, it is common for people to send Christmas cards to their friends and family during the Christmas season. The cards often have family photos or other decorative images and contain well wishes for this celebratory time of year. Moreover, the cards are often displayed in a visible location at the receiving party's residence. Some people, for example, put Christmas cards on the mantle of their fireplace or on window sills for decoration.

To enhance the holiday atmosphere, and to combine two common festive practices in a new and creative way, it would be useful to decorate a Christmas tree with one or more Christmas cards. In other words, it would be desirable to use Christmas cards as ornaments on a Christmas tree. Unfortunately, at present, there is not a system or method for effectively displaying Christmas cards on a tree. In some instances, people have attempted to wedge the cards between branches of a tree, but this method seldom holds the cards for longer than a few minutes and can also deform the cards. People have also hung cards from traditional "J" shaped ornament hangers. This method, however, often requires punching a hole in the card, hanging the card so that the view of the card is obstructed by branches of the tree, or hanging the card so that its position is affected by neighboring branches. Thus, it is desirable to decorate a tree without having to punch holes in the card, and to hold the cards a distance away from the branches to enable easy viewing and good positioning.

What is needed, therefore, is a holder that can effectively display cards, or other similar decorations, on a Christmas tree. The holder should be simple yet sturdy, and should prevent the cards from falling from the tree. The holder should also be able to hold the cards some distance away from the tree, and should not require making holes in the cards. It is to such systems and methods that the present invention is primarily directed.

SUMMARY

A decoration holder is described herein. In some embodiments, the holder can enable one or more Christmas cards to decorate a Christmas tree. More specifically, the holder can be coupled to the tree, and a card can be attached to the holder, to enhance the decorative appearance of the tree. The holder can hold the card a distance away from the tree, preventing the branches of the tree from obstructing the view of the card or affecting the position of the card. The holder can also hold the card on the tree reliably without the need to put a hole in the card.

In some embodiments, the holder can comprise an extending portion, a coupling portion, and a receiving portion. The coupling portion can couple to a Christmas tree or other support system, and the receiving portion can receive and attach to a card or other decoration. The extending portion can extend between the coupling portion and the receiving portion. In this manner, the holder can couple to a tree and hold a card, providing a desired holiday decoration.

In some embodiments, the holder can comprise a receiving portion located at a first end of the decoration holder and configured to hold a decoration. The holder can also comprise a coupling portion located at a second end of the decoration holder and configured to couple the decoration holder to the Christmas tree, wherein the coupling portion forms a zig-zag shape. The holder can further comprise an extending portion configured to extend substantially parallel to a branch of the Christmas tree and configured to locate the receiving portion such that the decoration held by the receiving portion is not obstructed from view by the branch of the Christmas tree.

In some embodiments, the holder can comprise a single piece of wire and the receiving portion is a spiraled portion of the single piece of wire oriented substantially perpendicular to the extending portion. In some embodiments, the spiraled portion can be round, and in other embodiments the spiraled portion can be square, triangular, diamond-shaped, hexagonal, or octagonal. In some embodiments, the receiving portion may be one of a clip, a clamp, and a grip.

In some embodiments, the coupling portion can be coupled to the branch of the Christmas tree by a string wrapping surrounding the coupling portion and the branch. In some embodiments, the coupling portion may wrap around the branch of the Christmas tree.

In some embodiments, a decoration display system according to the present disclosure can comprise a support system and a decoration holder coupled to the support system. In some embodiments, the system can comprise a receiving portion located at a first end of the decoration holder and configured to hold a decoration. In some embodiments, the system can also comprise a coupling portion located at a second end of the decoration holder and comprising a zig-zag shape, the coupling portion and a branch of the support system wrapped with string to couple the decoration holder to the support system. In some embodiments, the system can further comprise an extending portion extending away from the coupling portion and configured to locate the receiving portion such that the decoration held by the receiving portion is not obstructed from view by a portion of the support system.

In some embodiments, the holder can comprise a single piece of wire and the receiving portion is a spiraled portion of the single piece of wire oriented substantially perpendicular to the extending portion. In some embodiments, the spiraled portion can be round, and in other embodiments the spiraled portion can be square, triangular, diamond-shaped, hexagonal, or octagonal. In some embodiments, the receiving portion may be one of a clip, a clamp, and a grip.

In some embodiments, the coupling portion can be coupled to the branch of the support system by a string wrapping surrounding the coupling portion and the branch. In some embodiments, the coupling portion may wrap around the branch of the support system.

In some embodiments, the holiday decoration display system can comprise a Christmas tree comprising and a decoration holder. In some embodiments, the Christmas tree can comprise at least one substantially vertical trunk section, a plurality of branches extending substantially horizontally from the at least one substantially vertical trunk section, and a base configured to support the at least one substantially vertical trunk section.

In some embodiments, the decoration holder can comprise a coupling portion, an extending portion, and a receiving portion. In some embodiments, the coupling portion can comprise a zig-zag shaped first end of a piece of wire configured to be coupled to a branch of the plurality of branches of the Christmas tree. In some embodiments, the extending portion can comprise a middle section of the piece of wire that is oriented substantially parallel to the branch of the plurality of branches of the Christmas tree. In some embodiments, the receiving portion can comprise a circular spiral shaped second end of the piece of wire configured to hold a decoration between adjacent spirals of wire.

In some embodiments, the extending portion can be of sufficient length to extend away from the coupling portion a distance sufficient to locate the receiving portion such that a view of the decoration held by the receiving portion is substantially unobstructed. In some embodiments, the coupling portion can be wrapped with a string in order to couple the decoration holder to the Christmas tree.

Further features of the invention, and the advantages offered thereof, are explained in greater detail hereinafter with reference to specific embodiments illustrated in the accompanying drawings, wherein like elements are indicated by like reference numerals.

DETAILED DESCRIPTION

Figure 1:
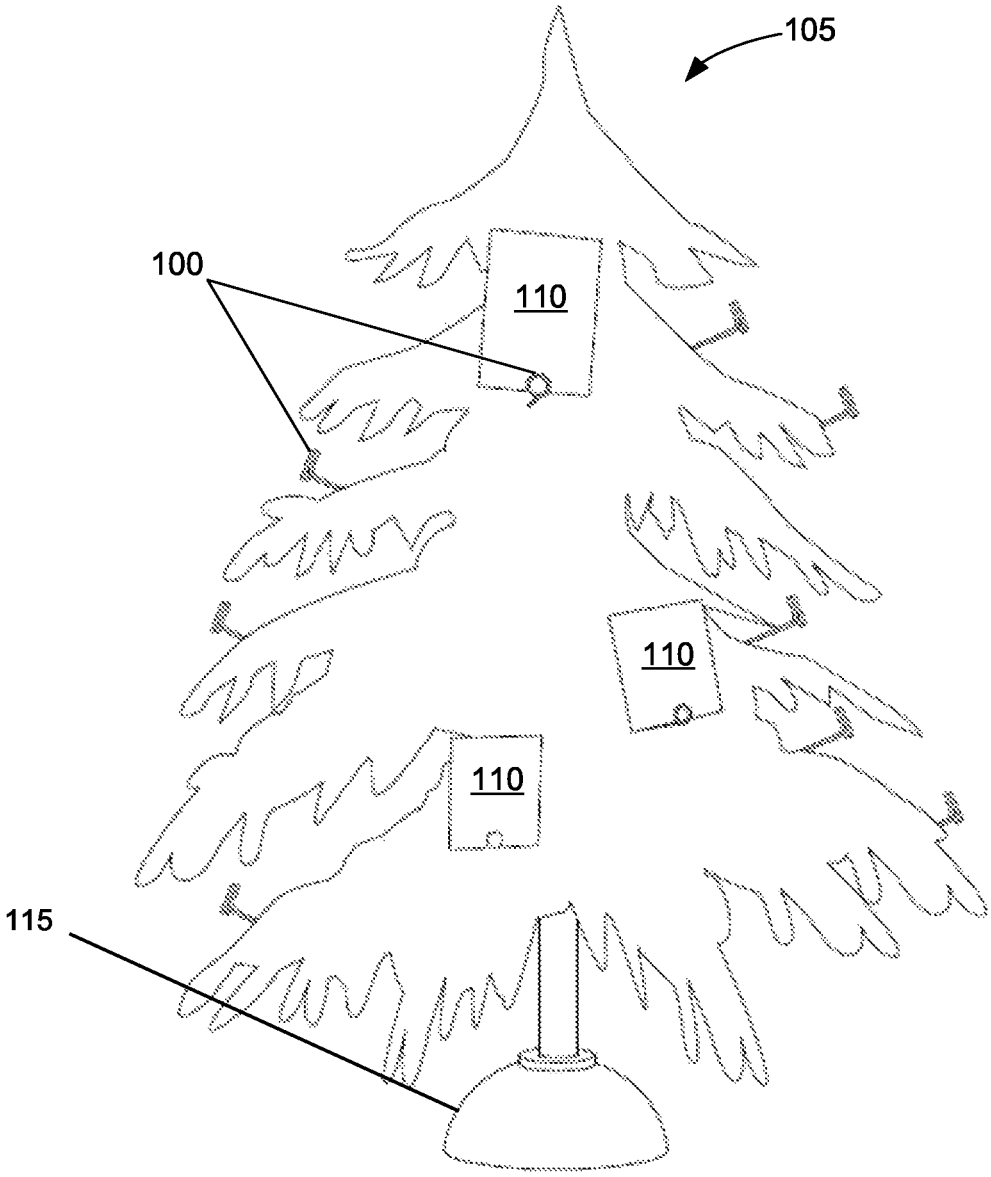
FIG. 1 depicts a tree with a plurality of holders, in accordance with some embodiments of the present invention.

To facilitate an understanding of the principles and features of the various embodiments of the invention, various illustrative embodiments are explained below. Although exemplary embodiments of the invention are explained in detail as being systems and methods for a decoration holder, it is to be understood that other embodiments are contemplated, such as embodiments employing other types of holders, decorations, cards, papers, sheets, and the like. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

To facilitate an understanding of the principles and features of this disclosure, various illustrative embodiments are explained below. In particular, various embodiments of this disclosure are described as a Christmas card holder. Some embodiments of the invention, however, may be applicable to other contexts, and embodiments employing these applications are contemplated. For example, and not limitation, some embodiments of the invention may be applicable to various types of cards and holders. Accordingly, where terms such as "Christmas card" or "Christmas tree" or related terms are used throughout this disclosure, it will be understood that other cards, trees, devices, entities, objects, or activities can take the place of these in various embodiments of the invention.

Embodiments of the present invention can enable Christmas cards to be employed as ornaments on a Christmas tree. In some embodiments, the present invention can be holder for a Christmas card that can attach to a Christmas tree such that the card can decorate the tree. The holder can reliably secure a card to the tree without the card falling from the holder, or the holder falling from the tree.

As shown in FIG. 1, one or more holders 100 can couple to a support system, such as a tree 105. The holders 100 can hold one or more decorations, such as Christmas cards 110, such that the cards 110 decorate the tree 105. Accordingly, the cards can enhance the festive appearance of the tree 105 and the holders 100 can provide a desirable place to display the cards 100.

Figure 2:
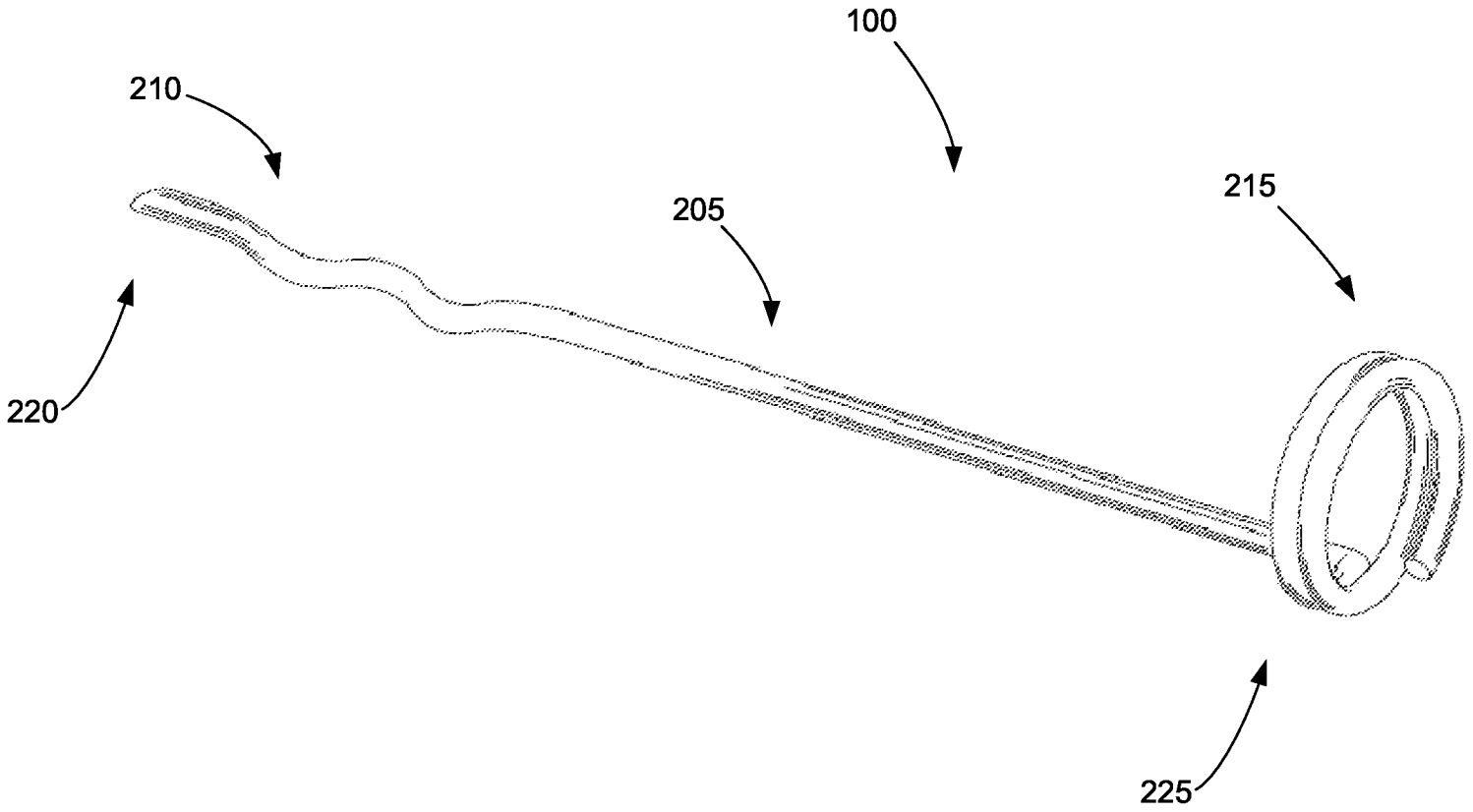
FIG. 2 depicts a perspective view of a holder, in accordance with some embodiments of the present invention.
Figure 3:
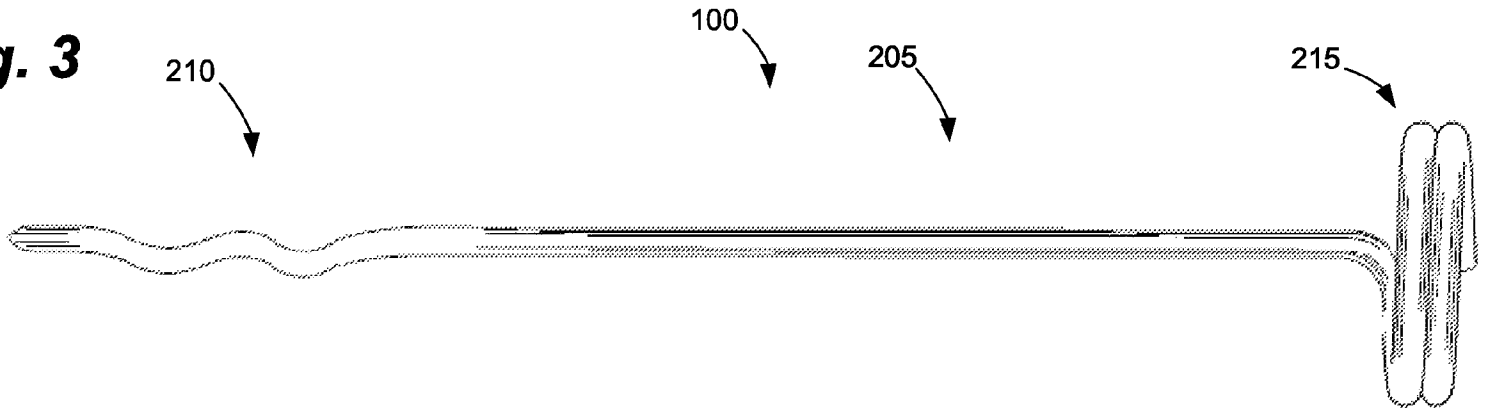
FIG. 3 depicts a top view of a holder, in accordance with some embodiments of the present invention.
Figure 4:
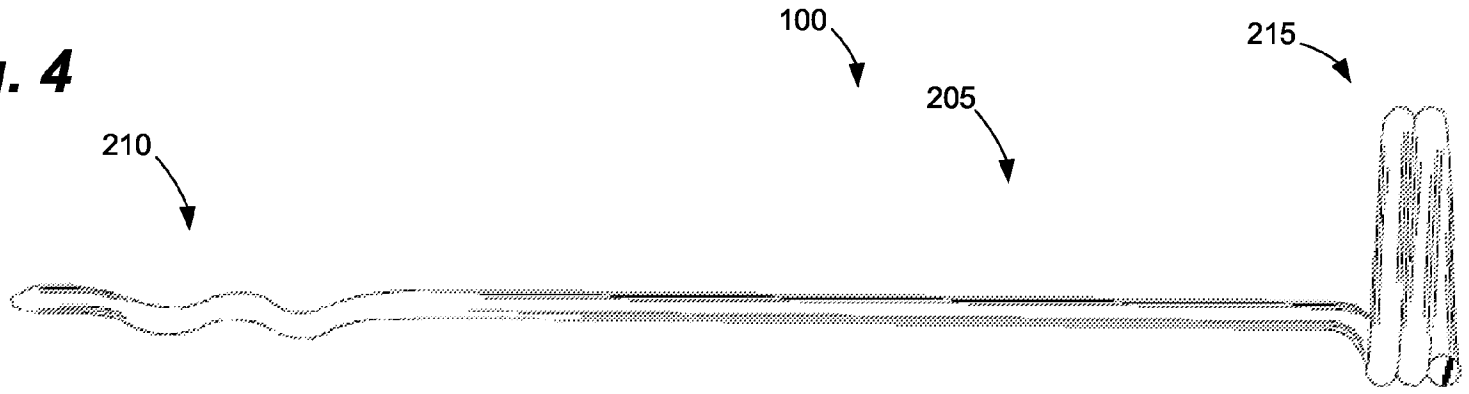
FIG. 4 depicts a side view of a holder, in accordance with some embodiments of the present invention.

As shown in FIGS. 2-4, a holder 100 can comprise an extending portion 205, a coupling portion 210, and a receiving portion 215. In some embodiments, the coupling portion 210 can be disposed proximate a first end 220 of the holder 100 and the receiving portion 215 can be disposed proximate a second end 225 of the holder 100. In some embodiments, the first end 220 and the second end 225 can be at opposite ends of the holder 100. Moreover, the extending portion 205 can be disposed between the coupling portion 210 and the receiving portion 215. In some embodiments, extending portion 205 extends substantially parallel to a branch of the Christmas tree.

Figure 6:
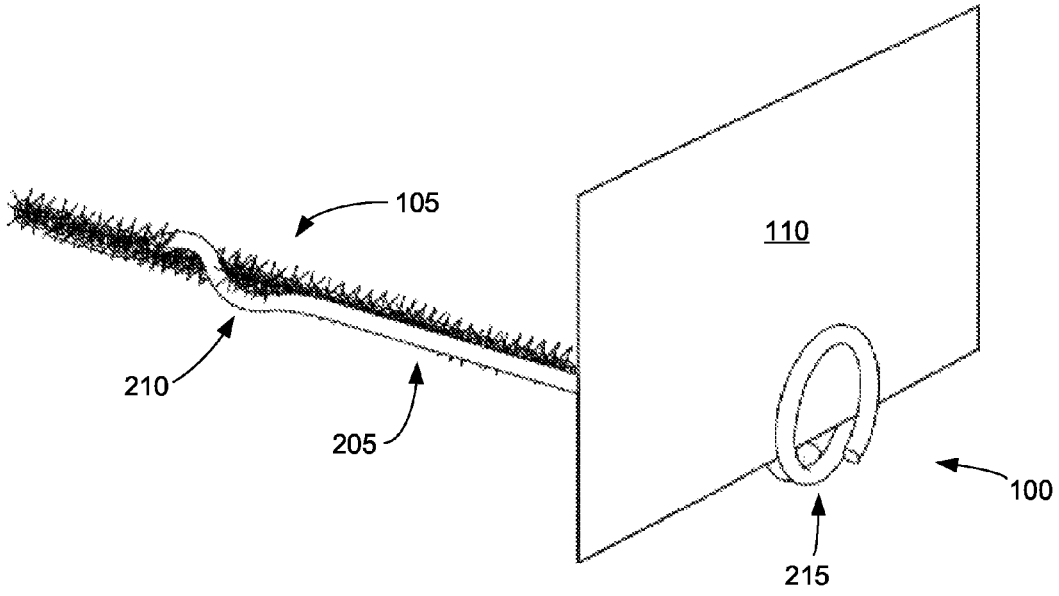
FIG. 6 depicts a close up view of a holder coupled to a branch of a tree, in accordance with some embodiments of the present invention.

In some embodiments, the coupling portion 210 can couple to a support system, such as a tree 105. More specifically, in some embodiments, the coupling portion 210 can be wrapped around a branch of a tree 105, as shown in FIG. 6. In other words, when coupling the holder 100 to the tree 105, a consumer can twist or wrap the coupling portion 210 around a branch, thereby ensuring that the holder 100 is reliably coupled to and supported by the tree 105. Alternatively or additionally, coupling portion 210 may be tied, glued, or otherwise secured to a portion of a support system.

In some embodiments, the coupling portion 210 can be coupled to the tree 105 with an adhesive or with a coupling member. The adhesive can be glue or other suitable mixture. For example, the coupling member can be string, tape, or plastic wrap. In some embodiments, the coupling member can be wrapped around the coupling portion 210 and a branch of the tree 105 to couple the coupling portion 210, and thus the holder 100, to the branch. In some embodiments, the coupling member can be wrapped around the coupling portion 210 and the trunk of the tree 105 to couple the coupling portion 210, and thus the holder 100, to the tree 105.

Figure 7:
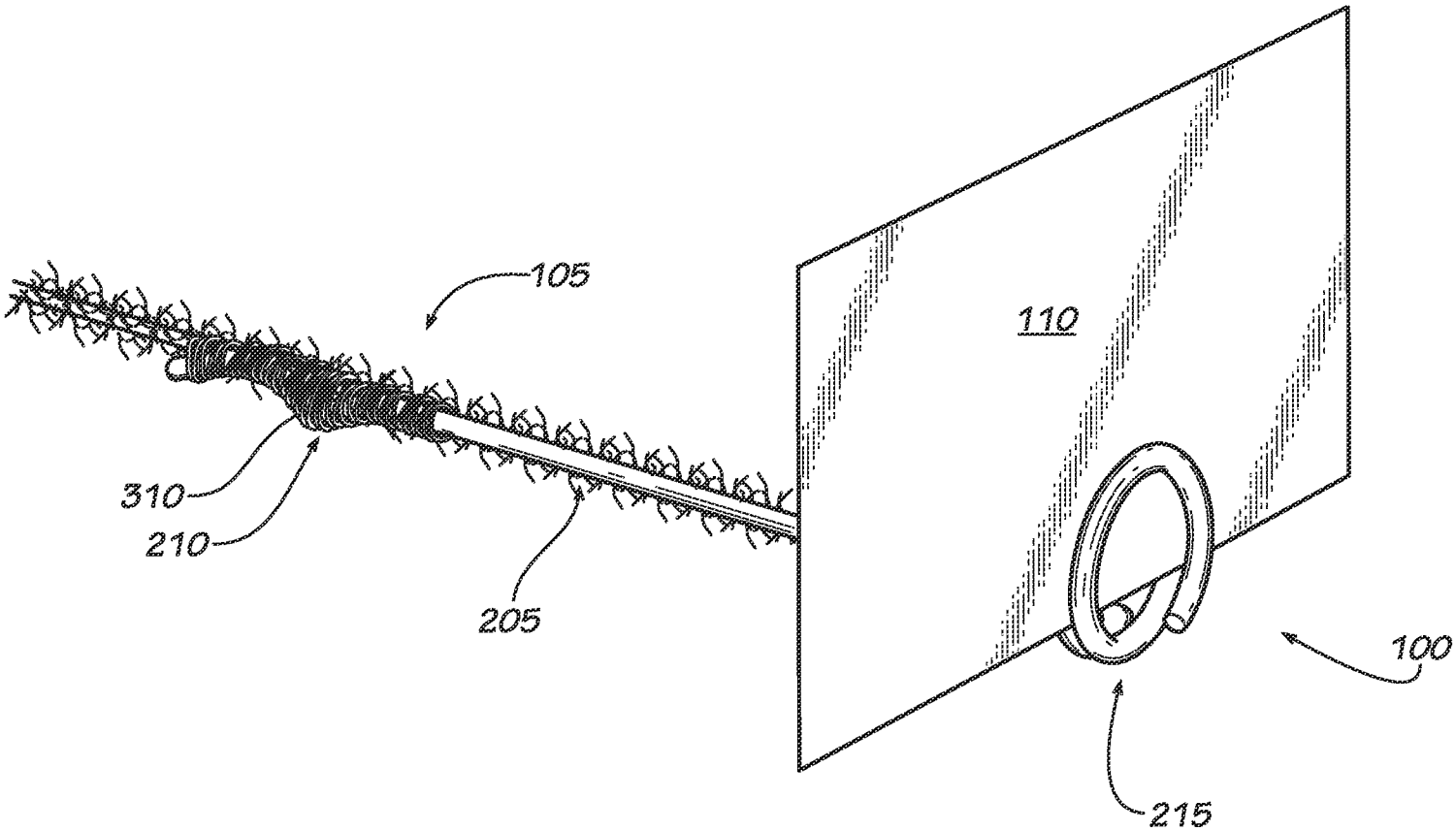
FIG. 7 depicts a close up view of a holder coupled to a branch of a tree, in accordance with some embodiments of the present invention.

FIG. 7 illustrates one manner of attaching holder 100 to tree branch 105. In some embodiments, string wrapping 310 can be used to couple coupling portion 210 to tree branch 105 by repeatedly wrapping the string around both the coupling portion 210 of holder 100 and tree branch 105.

String wrapping 310 can be preinstalled by the manufacturer, or can be installed by the consumer. Preinstalling string wrapping 310 can allow for a permanent installation on tree 105. Allowing the consumer to install holder 100 on tree 105 may allow the holders 100 to be sold separately from an artificial or real tree. The consumer can then locate the holders 100 at desired locations on tree 105.

As shown in FIGS. 2-4, the coupling portion 210 can comprise one or more bends, and can form a zig-zag shape. The zig-zag shape can facilitate coupling to the tree 105. In some embodiments, for example, the zig-zag shape can provide a wider area for the coupling portion 210 to contact a branch of the tree 105. In this manner, the zig-zag shape can prevent the holder 100 from rotating when it is coupled to the tree 105. Moreover, due to the zig-zag shape of coupling portion 210, the holder 100 can be inhibited from moving in a direction substantially parallel to tree branch 105. In some embodiments, coupling portion 210 can be shaped such that coupling portion 210 wraps around a branch of the tree 105 in addition to or instead of using a separate coupling member.

In some applications, holder 100 can be installed on a branch 105 of an artificial Christmas tree. Artificial Christmas trees may include a base 115, one or more substantially vertical trunk sections, and a plurality of branches extending from the one or more trunk sections. The plurality of branches may be integral to the one or more trunk sections or may be removably coupled to the one or more trunk sections. The plurality of branches may be shorter in length the further they are from the base 115. Holder 100 may be coupled to one of the plurality of branches or in some embodiments holder 100 can be coupled to the one or more trunk sections.

In some embodiments, the extending portion 205 can extend outwardly from the coupling portion 210. The extending portion 205, therefore, can space the receiving portion 215 from the coupling portion 210. Accordingly, in some embodiments, the extending portion 205 can ensure that the receiving portion 215 is substantially exterior to the tree 105 such that the card 110, or other decoration, is not obstructed by a branch of the tree 105 and such that the card's 110 position is not affected by a branch of the tree 105. Extending portion 205 can also extend substantially parallel to a branch, which may provide a desired appearance and help ensure that a view of the card 110 is not obstructed by other branches.

Figure 5:
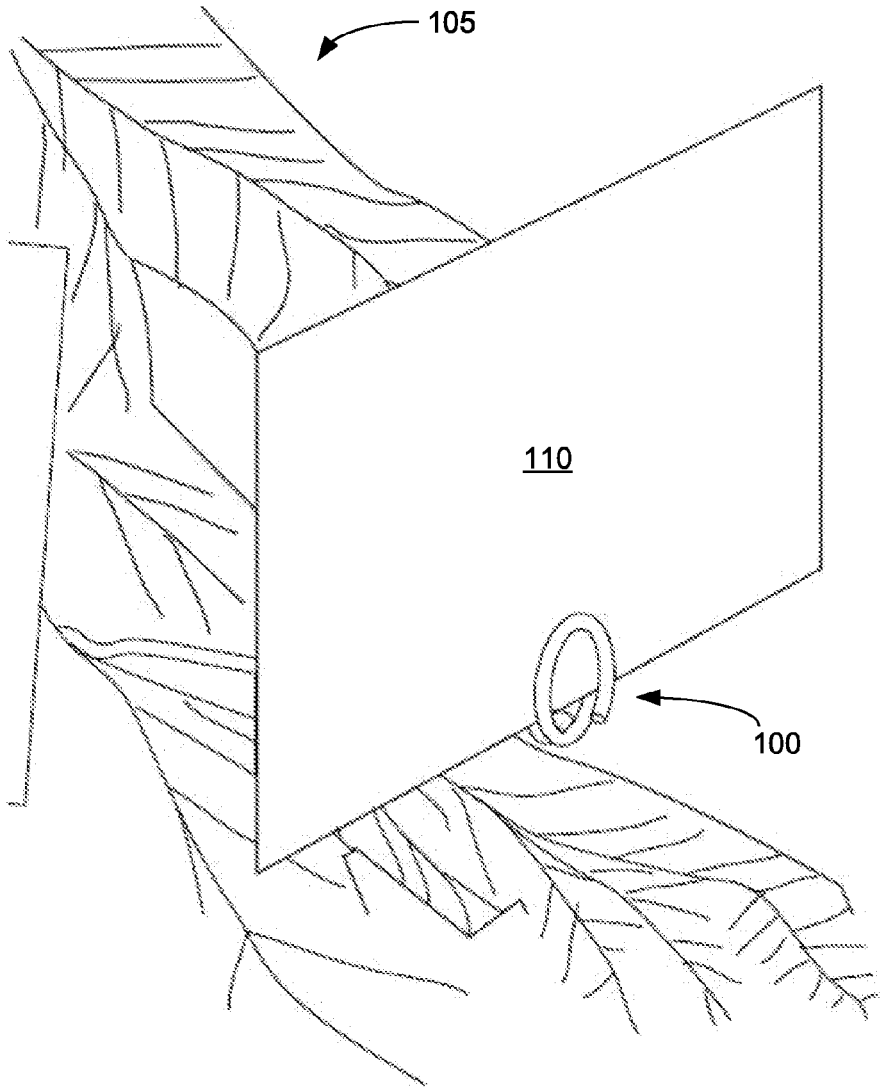
FIG. 5 depicts a close up view of a holder coupled to a tree, in accordance with some embodiments of the present invention.

In some embodiments, the receiving portion 215 can receive and hold the card 110, or other decoration. The receiving portion 215 can be, for example, a spiral, as shown in FIGS. 2 and 5-6. In some embodiments, receiving portion 215 may be oriented substantially perpendicular to extending portion 210. As shown in FIGS. 5-6, the spiral can receive the card 110 between neighboring rings, thereby securing the card 110 in place. In some embodiments, the spiral can be a round spiral, as shown in FIGS. 2 and 5-6, and in some embodiments the spiral can be square, triangular, diamond-shaped, hexagonal, octagonal, or the like. In some embodiments, the spiral can be decoratively shaped to resemble a Christmas tree, star, Santa Claus, snowman, reindeer, fireplace, or other shapes as desired.

In some embodiments, the receiving portion 215 is not a spiral, and instead can be a clip, clamp, grip, or the like. In some embodiments, such as embodiments employing a spiral or clamp, the receiving portion 215 can receive a card 110 without deforming or punching a hole in the card 100. In some embodiments, the receiving portion can be a decoratively shaped clip, clamp, grip or the like. For example, a clip may be shaped to resemble a Christmas tree, star, Santa Claus, snowman, reindeer, fireplace, or other shapes as desired.

In some embodiments, the receiving portion 215 can comprise an additional decoration. More specifically, in some embodiments, the receiving portion 215 can have an ornament, such as a tree ornament, star ornament, Santa Claus ornament, or the like disposed on the receiving portion 215. In some embodiments, the ornament can be disposed on the end of the receiving portion 215 such that the ornament faces outward from the tree 105 when the holder 100 is in use. This additional decoration can enhance the festive appearance of the holder 100.

In some embodiments, the holder 100 can comprise wire. The wire can be a metal wire, and can comprise copper, aluminum, or other suitable materials. In some embodiments, the wire can be made of a polymer, such as PVC or other plastic, or the wire can be made from a composite material.

In some embodiments, the holder 100 can be made from one piece of wire that is bent to form one or more of the components discussed herein. In other embodiments, the holder can comprise multiple pieces. For example, one or more of the extending portion 205, coupling portion 210, and receiving portion 215 can be detachable. In this matter, for example, a user can remove the receiving portion 215, attach it to a card 105, and subsequently attach the card 105 and receiving portion 215 to the extending portion 205 which can be already coupled to the tree 105 via the coupling portion 210.

In some embodiments, as discussed above, the holder 100 can be used with an artificial tree 105. Because the artificial tree 105 is designed and manufactured, it can be configured to facilitate coupling the holder 100 to the tree 105. For example, the tree 105 can be manufactured to have receiving portions, such as holes, in its branches. In some embodiments, the coupling portion 210 can be inserted into the receiving portions to couple the holder 100 to the tree 105. In some embodiments, moreover, the tree 105 can have clamps, clips, notches, nooks, or the like to secure the holder 100 to the tree 105. The tree 105 can also have branches that are shaped to prevent the holder 100 from moving on a given branch. For example, the a portion of the branches can be flat to provide a good gripping surface for the coupling portion 210 or can have barbs to prevent the coupling portion 210 from rotating or sliding off the end of the branch. Artificial trees may also be purchased with holders 100 already attached to a plurality of branches.

Those of skill in the art will understand that, as described herein, the holder 100 can couple to various objects, not only Christmas trees 105. The holder 100, for example, can couple to a variety of support systems, such as a wreath, garland, tabletop display, wall, shelf, mantle, decorative string, other type of tree, or the like. Moreover, the holder 100 can couple to various types of Christmas trees 105, such as cedars, cypress, fir, pine, spruce, evergreen, and the like. The holder 100 can also couple to artificial trees 105, such as artificial Christmas trees 105 that are widely available.

Moreover, the holder 100 can hold various decorations, not only Christmas cards 110. The holder 100 can hold, for example, other types of decorations, such as other types of cards, papers, ornaments, and the like.

It will be appreciated by those skilled in the art that the invention can be embodied in other specific forms without departing from the spirit or essential characteristics thereof. For example, while the invention has been described in the context of Christmas trees and Christmas cards, the concepts described herein need not be limited to these illustrative embodiments. For example, other types of decorations, or other types of trees or support systems, can be used. These other types of cards, trees, decorations, and systems can enjoy similar advantages as those described above.

Additionally, the specific configurations, choice of materials, and the size and shape of various elements can be varied according to particular design specifications or constraints requiring a holder constructed according to the principles of the invention. Such changes are intended to be embraced within the scope of the invention.

The presently disclosed embodiments are, therefore, considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A decoration display system comprising:

a tree, the tree comprising:

at least one substantially vertical trunk section, and a plurality of branches extending substantially horizontally from the at least one substantially vertical trunk section; and a decoration holder, the decoration holder comprising:

a coupling portion comprising a zig-zag-shaped first end;

a receiving portion located at a second end, the receiving portion extending in a substantially vertical plane and configured to hold a decoration; and an extending portion comprising a middle section that is located directly between the coupling portion and the receiving portion and that is oriented substantially parallel to a branch of the plurality of branches of the tree;

wherein the coupling portion rests against the branch such that one or more apexes of the zig-zag-shaped first end project in a substantially horizontal plane and project substantially perpendicularly to the length of the branch;

wherein the extending portion is of sufficient length to extend away from the coupling portion a distance sufficient to locate the receiving portion such that a view of the decoration, when held by the receiving portion, is substantially unobstructed by the tree; and an adhesive or a coupling member for securing the coupling portion to one of the plurality of branches, wherein the coupling member is selected from the group consisting of tape, plastic wrap, or string.

2. The decoration display system of claim 1, wherein the extending portion of the decoration holder is comprised of wire.

3. The decoration display system of claim 2, wherein the receiving portion is formed by the wire forming the extending portion.

4. The decoration display system of claim 3, wherein the receiving portion is a spiraled portion of the wire and is oriented substantially perpendicular to extending portion.

5. The decoration display system of claim 4, wherein the spiraled portion is round.

6. The decoration display system of claim 4, wherein the spiraled portion is square, triangular, diamond-shaped, hexagonal, or octagonal.

7. The decoration display system of claim 1, wherein the receiving portion is one of a clip, a clamp, and a grip.

8. The decoration display system of claim 1, wherein the coupling portion wraps around the branch of the tree.

9. The decoration display system of claim 1, wherein the decoration is a card.

10. A holiday decoration display system, comprising:

a Christmas tree comprising:

at least one substantially vertical trunk section;

a plurality of branches extending substantially horizontally from the at least one substantially vertical trunk section; and a base configured to support the at least one substantially vertical trunk section;

a decoration holder comprising:

a coupling portion comprising a zig-zag-shaped first end of a piece of wire;

a receiving portion comprising a circular spiral-shaped second end of the piece of wire, the receiving portion extending in a substantially vertical plane and configured to hold a decoration between adjacent spirals of wire; and an extending portion comprising a middle section of the piece of wire that is oriented substantially parallel to a branch of the plurality of branches of the Christmas tree;

wherein the coupling portion resting against the branch such that one or more apexes of the zig-zag-shaped first end project in a substantially horizontal plane and project substantially perpendicularly to the length of the branch, and wherein the coupling portion is wrapped with a string to couple the decoration holder to the branch; and wherein the extending portion is of sufficient length to extend away from the coupling portion a distance sufficient to locate the receiving portion such that a view of the decoration, when held by the receiving portion, is substantially unobstructed by the Christmas tree.

11. The decoration holder for a Christmas tree of claim 10, wherein the decoration is a card.

12. The decoration display system of claim 1, wherein the plurality of branches are removably coupled to the at least one substantially vertical trunk section.

13. The decoration display system of claim 1, wherein the plurality of branches are shorter in length the further away they are from the base.

14. The decoration display system of claim 1, wherein the tree is a Christmas tree.

* * * * *